US010316706B2

(12) United States Patent
Thielen et al.

(10) Patent No.: US 10,316,706 B2
(45) Date of Patent: Jun. 11, 2019

(54) CAMSHAFT ADJUSTER INCLUDING A BLOCKING PIN FOR PRESSURE RELIEF OF THE HYDRAULIC CHANNEL COVERED BY A SLOTTED GATE

(71) Applicant: Schaeffler Technologies AG & Co. KG, Herzogenaurach (DE)

(72) Inventors: Jochen Thielen, Nuremberg (DE); Olaf Boese, Nuremberg (DE); Torsten Zschieschang, Hagenbeuchach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 139 days.

(21) Appl. No.: 15/312,084

(22) PCT Filed: Jan. 26, 2015

(86) PCT No.: PCT/DE2015/200025
§ 371 (c)(1),
(2) Date: Nov. 17, 2016

(87) PCT Pub. No.: WO2015/176717
PCT Pub. Date: Nov. 26, 2015

(65) Prior Publication Data

US 2017/0107869 A1 Apr. 20, 2017

(30) Foreign Application Priority Data

May 21, 2014 (DE) ..... 10 2014 209 641

(51) Int. Cl.
*F01L 1/344* (2006.01)

(52) U.S. Cl.
CPC ... *F01L 1/3442* (2013.01); *F01L 2001/34423* (2013.01); *F01L 2001/34453* (2013.01)

(58) Field of Classification Search
CPC ..... F01L 1/3442; F01L 2001/34423; F01L 2001/34453; F01L 2001/34469; F01L 1/46
(Continued)

(56) References Cited

U.S. PATENT DOCUMENTS 8,360,022 B2 1/2013 Ozawa et al.
8,973,542 B2 3/2015 Morehead et al.
(Continued)

FOREIGN PATENT DOCUMENTS

CN 103670574 A 3/2014
DE 102005024242 A1 12/2006
(Continued)

*Primary Examiner* — Jorge L Leon, Jr.
(74) *Attorney, Agent, or Firm* — Davidson, Davidson & Kappel, LLC

(57) ABSTRACT

A camshaft adjuster for an internal combustion engine, having a stator, a rotor mounted rotatably in the interior of the stator, and a locking cover connected to the stator. A hydraulically actuatable locking element is received in the rotor and engages into the locking cover in at least one blocking position, so as to block a rotation of the rotor relative to the stator, and is arranged in at least one unlocking position so that the rotor can be rotated relative to the stator. A blocking pin acts in at least one hydraulic channel connected hydraulically to the locking element so that the hydraulic channel is connected to a recovery tank or is disconnected from the recovery tank depending on the position of the blocking pin, wherein the hydraulic channel has a first channel section in the locking cover, and the first channel section and the blocking pin are arranged so that the blocking pin seals the hydraulic channel from the recovery tank in at least one first end position, in a first pressure range which prevails in the hydraulic channel by way of contact with the locking cover.

13 Claims, 2 Drawing Sheets

(58) Field of Classification Search
USPC ..... 123/90.17
See application file for complete search history.

(56) References Cited

U.S. PATENT DOCUMENTS

| | | | | |
|---|---|---|---|---|
| 9,080,475 | B2 | 7/2015 | Kobayashi et al. | |
| 2010/0050966 | A1* | 3/2010 | Ozawa | F01L 1/3442 123/90.17 |
| 2010/0199938 | A1* | 8/2010 | Hamaoka | F01L 1/3442 123/90.17 |
| 2013/0104822 | A1 | 5/2013 | Dupuis | |
| 2014/0130755 | A1* | 5/2014 | Kobayashi | F01L 1/3442 123/90.17 |

FOREIGN PATENT DOCUMENTS

| | | |
|---|---|---|
| DE | 102012105524 | 4/2014 |
| EP | 2397661 | 12/2011 |
| EP | 2730756 | 5/2014 |

* cited by examiner

CAMSHAFT ADJUSTER INCLUDING A BLOCKING PIN FOR PRESSURE RELIEF OF THE HYDRAULIC CHANNEL COVERED BY A SLOTTED GATE

The present invention relates to a camshaft adjuster, namely preferably a vane-type hydraulic camshaft adjuster for an internal combustion engine, for example a gasoline or diesel engine, of a motor vehicle, such as a passenger car, truck, bus or agricultural commercial vehicle, including a stator, including a rotor rotatably supported in the interior of the stator as well as including a locking cover connected to the stator, a hydraulically actuatable locking element being accommodated in the rotor, which engages with the locking cover in at least one blocking position and blocks a rotation of the rotor relative to the stator and is situated in at least one unlocking position in such a way that the rotor is rotatable relative to the stator, a blocking pin acting in at least one hydraulic channel, which is hydraulically connected to the locking element, in such a way that the hydraulic channel is connected to a recovery tank or is disconnected from the recovery tank depending on the position of the blocking pin.

BACKGROUND

In principle, camshaft adjusters of this type are already known in various designs from the prior art. These camshaft adjusters may be integrated into a timing drive of the internal combustion engine and be provided, for example, for chain or belt drives.

DE 10 2005 024 242 A1 known from the prior art discloses a device for variably setting the timing of gas exchange valves of an internal combustion engine. This device includes a drive element, which is in drive connection with a crankshaft, and an output element, which is in drive connection with a camshaft, at least one pressure chamber being formed between the drive element and the output element, and each pressure chamber being divided into two oppositely acting pressure chambers by a vane which is rotatably fixedly situated or formed on the output element. First and second pressure medium lines are also present, pressure medium being conductible to or removable from the first pressure chambers via the first pressure medium lines, and pressure medium being conductible to or removable from the second pressure chambers with the aid of the second pressure medium line. A locking device is also present in the device, which includes a receptacle formed on the output element or the drive element, a slotted gate formed on the other component, a locking pin situated in the receptacle and a spring, which pushes the locking pin in the direction of the component on which the slotted gate is formed. The locking pin engages with the slotted gate in a defined locking position of the output element relative to the drive element, it being possible to push the locking pin back into the receptacle by the application of pressure medium to the slotted gate, and at least one pressure medium connection being provided between the slotted gate and the pressure chamber or the associated pressure medium lines, to which pressure medium is applied for the purpose of withdrawing the drive element from the locking position. Each pressure medium line is implemented with the aid of exactly one pressure medium channel, the pressure medium channel being connected to the pressure chamber or the pressure medium line, on the one hand, and to the slotted gate, on the other hand, one of the two connections being established in each position of the output element relative to the drive element, and the other connection and the connection between the pressure medium channel and the locking pin being established only when the output element is in the locking position relative to the drive element.

SUMMARY OF THE INVENTION

The applicant is also aware of internal technology that has not yet been published, in which the hydraulic channel (also referred to as the control channel) is controlled with the aid of a kind of switching valve, and a relief of the hydraulic channel (also referred to as the C channel) takes place with the aid of a hollow pin.

In the embodiments known from the prior art or previously, however, it is disadvantageous that long flow paths of the hydraulic medium (e.g., oil), in turn, are effectuated in the hydraulic channel, since relatively complex switching valves are used (for example, a separate, additional C port, a separate control channel being present for the locking pin/locking element). Due to these relatively long flow paths and the relatively complex design of the switching valves used, the flow resistance, i.e. the resistance in the flow channel, is relatively high, so that excessively long load times may occur when switching from the blocking position to the unblocking position and/or vice versa. When the engine stops, in particular, it is necessary to ensure a fast relief of the hydraulic channel/C channel by opening the hydraulic channel in the direction of the recovery tank. Also when the engine starts up, a rapid closing/locking of the hydraulic channel is to take place in the direction of the recovery tank to place the camshaft adjuster preferably quickly in the unblocking position, in which the rotor is rotatable again relative to the stator.

It is an object of the present invention to eliminate the disadvantages known from the prior art or previously and to ensure a fast and safe closing/blocking behavior of the hydraulic channel in the direction of the recovery tank when the engine starts up.

The present invention provides that the hydraulic channel includes a first channel section, introduced into the locking cover, the first channel section and the blocking pin being designed and situated relative to each other in such a way that the blocking pin seals the hydraulic channel from the recovery tank in at least one first end position, within a first pressure range prevailing in the hydraulic channel by way of contact with the locking cover.

As a result, the blocking pin and the locking cover themselves are used directly as sealing elements, for example in the blocking position. The blocking pin as such may have a much simpler and more compact structural design. This, in turn, effectuates a faster response of the locking system when switching between the blocking and unblocking positions and vice versa.

According to another specific embodiment, it is thus advantageous if the blocking pin is displaceable between the first end position, in which it is situated/pushed/placed up to a determined, first hydraulic pressure value, and a second end position, in which it is situated/pushed/placed upon reaching a second hydraulic pressure value (second hydraulic pressure value is preferably greater than the first hydraulic pressure value), in the axial direction within the rotor for the purpose of switching from the blocking position to the unblocking position. A particularly space-saving design may thus be implemented, as well as a blocking pin which has a blocking effect in both the first and the second end position and separates the hydraulic channel from the recovery tank.

The blocking pin is furthermore provided in such a way that it hydraulically connects the hydraulic channel to the recovery tank in an intermediate position, i.e. a displacing position, between the first and second end positions. The particular settable intermediate position is dependent on the hydraulic pressure value prevailing in the hydraulic channel, the higher the hydraulic pressure value in the hydraulic channel upon exceeding the first hydraulic pressure value, the closer is the blocking pin displaced/pushed/positioned in the direction of the second end position until the blocking pin arrives at the second end position upon reaching the second hydraulic pressure value. This means that, together with the blocking pin, a pressure relief valve/pressure relief unit is made available with the aid of which hydraulic pressure may be built up and reduced within the hydraulic channel (depending on the position of the blocking pin). A particularly simple and space-saving system is facilitated thereby.

In this case, it is also advantageous if the blocking pin has a first end face facing the locking cover, which abuts the first channel section in a sealing manner in the first end position. Due to an end face of this type, the first channel section may be easily formed in the locking cover, whereby the manufacture of the camshaft adjuster is further simplified.

It is also advantageous if the blocking pin has a second end face facing away from the locking cover in the operating state of the camshaft adjuster, which rests against the hydraulic channel in the second end position on the rotor side, thereby sealing the recovery tank. A second stop of the blocking pin is easily provided thereby, for the purpose of blocking/sealing the recovery tank even under the high operating pressure (namely the second hydraulic pressure value) upon the recovery tank during operation. The second end position is preferably assumed in the unblocking position, and the first end position is preferably assumed in the blocking position, the intermediate position being usable for the purpose of switching back and forth between the unblocking position and the blocking position.

If the first end face is furthermore provided with an annular design, and if the hydraulic pressure set in the hydraulic channel is applied to a portion of the first end face in the first end position, the switching behavior between the blocking position and the unblocking position may, in particular, be further improved. After all, the hydraulic pressure prevailing in the hydraulic channel thus does not act upon the entire first end face but only on one portion which is why a higher pressure value must initially be reached to displace the blocking pin than if the hydraulic pressure were to act upon the entire first end face. The hydraulic pressure prevailing in the hydraulic channel is thus not applied to another, second and/or third portion of the first end face in this first end position. This has the advantage that the blocking pin is accelerated and moved much faster upon reaching the first hydraulic pressure value, due to the higher level of the hydraulic pressure value required for moving the blocking pin. After all, when the blocking pin lifts off of the locking cover, the hydraulic pressure prevailing in the hydraulic channel is applied to the entire first end face, whereby an additional acceleration of the blocking pin occurs. The hydraulic pressure prevailing in the hydraulic channel acts upon the entire first end face in each intermediate position between the first and the second end positions. The corresponding hydraulic pressure/hydraulic pressure value then also acts upon the entire first end face in the second end position.

In this case, it is furthermore advantageous if the first end face of the blocking pin has a smooth/even design, whereby a sealing action in the first end position is further simplified.

If the blocking pin is also designed as a hollow pin and has a continuous through-hole in the axial direction, the hydraulic connection between the first and the second end position is particularly easy to carry out in the intermediate positions of the blocking pin.

In this case, it is also advantageous if the blocking pin has a flow diaphragm which reduces the cross section of the through-hole. The flow diaphragm is preferably situated in the through-hole (viewed in the axial direction), adjacent to the first end face. The through-hole thus expands from a first diameter in the area of the first end face to a second diameter in the area of the second end face. The flow may be efficiently regulated thereby.

In this case, it is also advantageous if the axial width of the flow diaphragm is smaller than the length of the blocking pin. Alternatively or additionally, if the surface area of the flow diaphragm is smaller than the surface area of the through-hole, a particularly effective blocking and connection of the hydraulic channel is made possible in the direction of the recovery tank in the particular blocking or unblocking position of the camshaft adjuster.

If the blocking pin is furthermore partially or entirely manufactured from a plastic material and/or a metal material, the blocking pin may furthermore be provided with a particularly lightweight and wear-resistant design, which, in turn, is advantageous with respect to the response time.

It is also preferred if the through-hole is designed as a bore, namely a through-bore, whereby the manufacture of the through-hole is further simplified.

It is also advantageous if the through-hole is situated and designed in such a way that a flow of hydraulic medium is prevented in the first end position of the blocking pin. The pressure in the area of the blocking pin may be particularly rapidly built up thereby for switching between the blocking position and the unblocking position, without a certain portion escaping through the through-hole.

If the first channel section is hydraulically connected to a second channel section of the hydraulic channel introduced into the rotor, the locking cover need only be provided with the first channel section around a certain circumferential area, whereby its manufacturing costs are further reduced. This channel section is preferably pressed in or milled in or manufactured by sintering.

It is furthermore advantageous if the blocking pin is spring-pretensioned in such a way that it abuts the locking cover in a supporting manner in the blocking position (in the first end position), thereby sealing the hydraulic channel from the recovery tank. As a result, a seal is ensured in the blocking position, which is reproducibly situated directly in the first end position for generating the unblocking position during the pressure buildup. The switching times are further shortened thereby.

BRIEF DESCRIPTION OF THE DRAWINGS

The present invention is now described below on the basis of multiple figures, in which connection different specific embodiments are explained.

DETAILED DESCRIPTION

Figure 1:
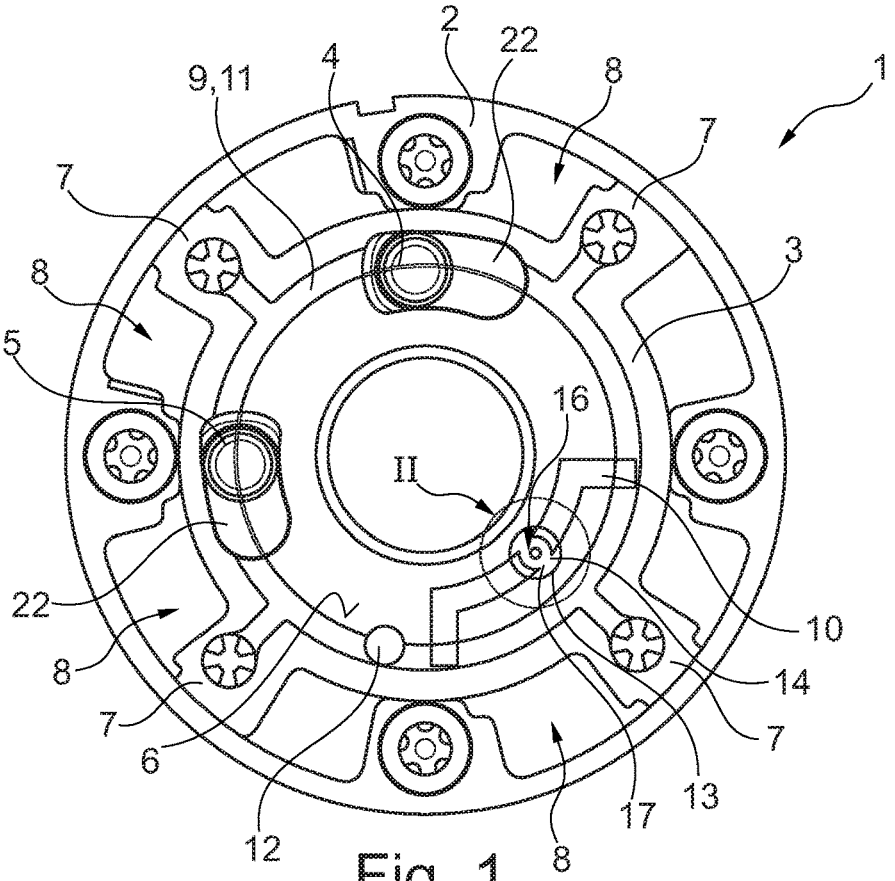
FIG. 1 shows a front view of a camshaft adjuster according to the present invention according to a first specific embodiment, the camshaft adjuster being illustrated from a side on which the locking cover is situated, and the camshaft adjuster being situated in a blocking position, in which the locking elements engage with locking gates of the transparently illustrated locking cover.

The figures are only of a schematic nature and are used exclusively for the sake of understanding the present invention. Identical elements are provided with identical reference numerals.

Camshaft adjuster 1 according to the present invention is clearly apparent in FIG. 1 according to a first specific embodiment. The camshaft adjuster as such is designed, in principle, like the one disclosed in DE 10 2005 024 242 A1, the disclosure being therefore regarded as incorporated by reference herein. Camshaft adjuster 1 is thus provided for an internal combustion engine of a motor vehicle and includes both a stator 2, which is rotatably fixedly connected to a crankshaft of the internal combustion engine in the operating state, preferably with the aid of a timing drive (belt or chain drive), and which is drivable thereby, and a rotor 3, which is fastened to a camshaft of the internal combustion engine in the operating state and is rotatably supported in the interior of stator 2. A hydraulically actuatable first locking element 4 as well as a likewise hydraulically actuatable second locking element 5 are accommodated in the rotor. In a blocking position, first and second locking elements 4 and 5 each engage with a locking cover 6, which is rotatably fixedly connected to stator 2, in such a way that a rotation of rotor 3 relative to stator 2 is avoided/blocked in this blocking position. In an unblocking position of camshaft adjuster 1, these locking elements 4 and 5 are situated in such a way that rotor 3 is able to rotate relative to stator 2. The blocking position in this case is designed as a central locking position, for which reason, in the blocking position, vanes 7 of rotor 3 are situated centrally in the particular working chambers 8 formed in stator 2.

A hydraulic channel 9 is furthermore provided between locking cover 6 and rotor 3. This hydraulic channel 9 includes a channel section, hereinafter referred to as second channel section 11, which is formed/introduced/milled in on the side of rotor 3 facing locking cover 6 (in the operating state). This second channel section 11 is hydraulically connected to an inlet/inlet opening 12, which is further connected to a delivery pump. Hydraulic channel 9 also includes a first channel section 10, which is (hydraulically) connected to second channel section 11 and which is formed by a channel-shaped recess on the end face facing rotor 3 in the operating state. First channel section 10, which is formed in the manner of a slotted gate, as is further apparent in FIG. 1, runs from second, essentially annular channel section 11 inwardly to an outlet opening 13 in the radial direction, from two areas which are spaced a distance apart along the circumference.

A blocking pin 14, which is displaceable in the axial direction, is situated in outlet opening 13. Outlet opening 13 also extends essentially in the axial direction (i.e., along the rotation axis of camshaft adjuster 1). Second channel section 11 of hydraulic channel 9 is hydraulically connected to the two locking elements 4 and 5, on the one hand, and to first channel section 10, on the other hand. Blocking pin 14 is situated in such a way and acts upon hydraulic channel 9 in such a way that hydraulic channel 9 is connectable to a recovery tank, which is not illustrated in greater detail here for the sake of clarity, or is disconnectable from the recovery tank, depending on its position. First channel section 10 and blocking pin 14 are designed and situated relative to each other in such a way that blocking pin 14 seals hydraulic channel 9 from the recovery tank in at least one first end position, as illustrated in FIGS. 1 and 2, within a first pressure range set in the hydraulic channel, by way of contact with locking cover 6.

For switching from the blocking position into the unblocking position, blocking pin 14 is displaceably supported in the axial direction within rotor 3 between the first end position, in which blocking pin 14 is situated up to a predetermined first hydraulic pressure value (measured in hydraulic channel 9), and a second end position, in which it is situated upon reaching a second hydraulic pressure value, which is greater than the first hydraulic pressure value. In both the first end position and the second end position, blocking pin 14 has a blocking/obstructing effect on hydraulic channel 9 and prevents a pressure fluid flow from hydraulic channel 9 to the recovery tank and vice versa.

Figure 2:
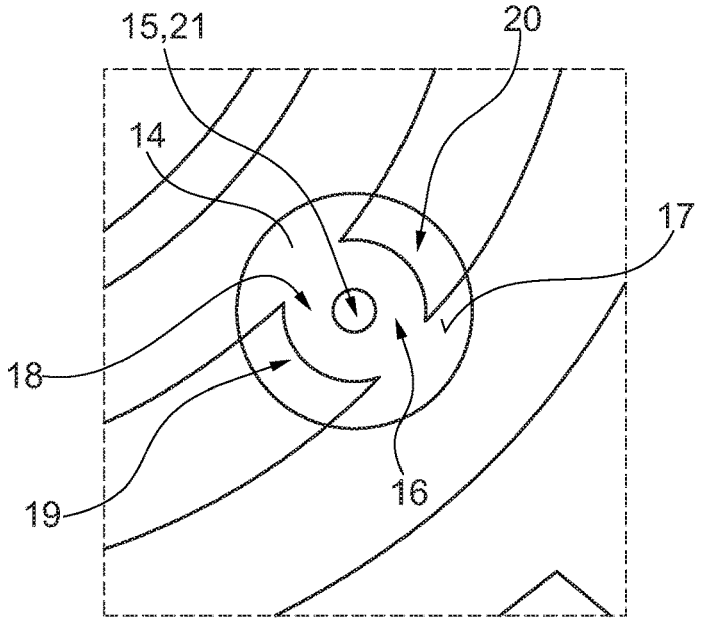
FIG. 2 shows a detailed view of the area of the end face of the blocking pin identified by II in FIG. 1, the contact of the blocking pin in the first end position being apparent in particular, in which the through-hole of the blocking pin is hydraulically separated from the hydraulic channel.
Figure 3:
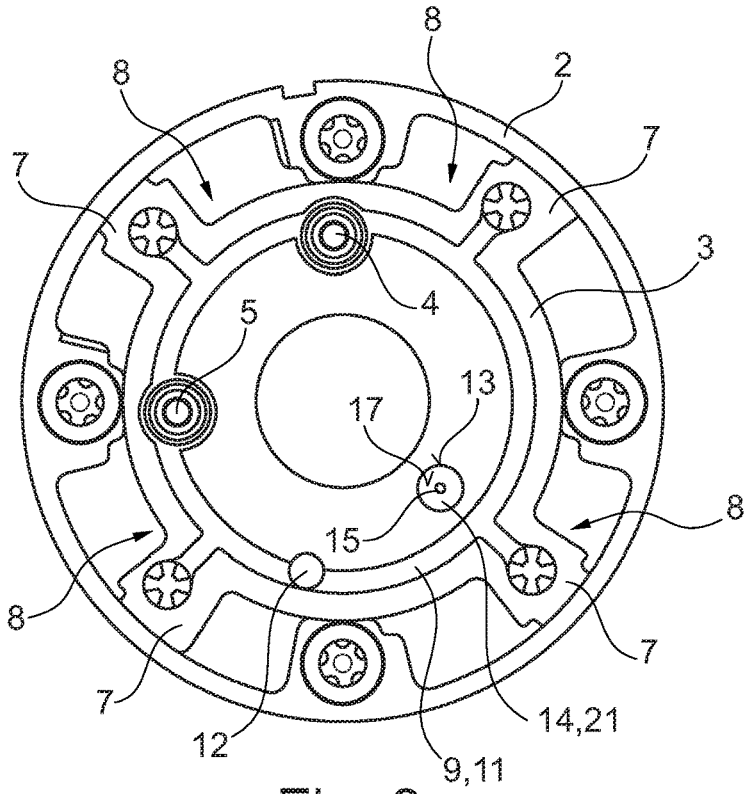
FIG. 3 shows a front view of the camshaft adjuster according to the present invention, as illustrated in FIG. 1 above, but with the locking cover removed in this case.

As is furthermore clearly apparent in interaction with FIGS. 2 and 3, blocking pin 14 has an essentially circular outer circumferential surface. Centrically, blocking pin 14 has a through-hole 15 designed as a through-bore, which completely penetrates blocking pin 14 over its entire length.

As is also clearly apparent in connection with FIGS. 1 and 2, through-hole 15 is introduced into blocking pin 14 in such a way, and blocking pin 14 abuts a projection area 16 introduced into first channel section 10 by a first annular end face 17 acting as a sealing surface in such a way that no hydraulic medium flows between hydraulic channel 9 and through-hole 15.

First channel section 10 is interrupted by projection area 16 and is thus divided geometrically into two parts. Projecting area 16 has an essentially circular design and forms an essentially circular elevation, which forms a flat surface, on which blocking pin 14 rests planarly with its end face 17, as is apparent in FIG. 2. The contact between projection area 16 and a first portion 18 of first end face 17 thus forms a seal. In other words, through-hole 15 is hydraulically separated from hydraulic channel 9 in the first end position.

In a second portion 19 and a third portion 20, first channel section 10 circumvents first end face 17 in the first end position, where it acts upon first end face 17 with the aid of the hydraulic pressure of hydraulic channel 9. The second and third portions 19 and 20 particularly preferably occupy approximately one third of the total area of first end face 17. Blocking pin 14 is also referred to as a hollow pin, due to the formation of through-hole 15.

A flow diaphragm 21 abuts first end face 17 directly in through-hole 15. In other words, through-hole 15 forms flow diaphragm 21 in the area of first end face 17. Flow diaphragm 21 extends only over a certain length of blocking pin 14, the (first) diameter of flow diaphragm 21 expanding to a second diameter, which is larger than the first diameter, with respect to second end face of blocking pin 14 facing away from first end face 17.

The second end face, which is not illustrated herein for the sake of clarity, in turn, abuts a rotor-fixed component, i.e. on the rotor side, in a second end position of blocking pin 14, again sealing the recovery tank against hydraulic channel 9. Blocking pin 14 is furthermore spring-elastically pretensioned with the aid of a spring element, which is also not illustrated herein for the sake of clarity, in such a way that it is pressed out of outlet opening 13 in the direction of locking cover 6. The spring force of this spring element is selected in such a way that blocking pin 14 is supported in the first end position within a first pressure range below a certain first hydraulic pressure value.

To switch from the blocking position into the unblocking position, the hydraulic pressure in hydraulic channel 9 is initially increased until the first hydraulic pressure value within hydraulic channel 9 is reached. If the first hydraulic pressure value is exceeded, first end face 17 lifts away from projection area 16, and through-hole 15 is unblocked.

This makes it possible for hydraulic medium to flow between hydraulic channel 9 and the recovery tank in an intermediate position/intermediate point between the second and first end positions of blocking pin 14. Due to the lifting action, the particular hydraulic pressure of hydraulic channel 9 no longer acts only upon the second and third portions 19 and 20 of blocking pin 14 but also upon entire first end face 17, i.e. upon first portion 18, whereby the force against the spring element is increased. As a result, an even faster displacement of blocking pin 14 occurs when switching from the blocking position into the unblocking position.

If the hydraulic pressure in hydraulic channel 9 is further increased to a second hydraulic pressure value, which is greater than the first hydraulic pressure value, blocking pin 14 strikes against the second end position. In this second end position, it again blocks hydraulic channel 9 from the recovery tank. At the same time, the two first and second locking elements 4 and 5 are pressed out of gate receptacles in locking cover 6 in the second end position, whereby rotor 3 is rotatable relative to stator 2.

Upon again switching from the unblocking position into the blocking position, the pressure is initially reduced via inlet line 12, whereby the pressure in the area of hydraulic channel 9 and thus also at first end face 17 is likewise reduced until blocking pin 14 is again moved back into the first end position due to the spring action of the spring element. As a result, the two locking elements 4 and 5, which are designed as locking pins, are again inserted into corresponding gate receptacle 22 in locking cover 6. The arrangement of inlet opening 12 relative to blocking pin 14 is, in turn, illustrated particularly clearly in FIG. 3.

Figure 4:
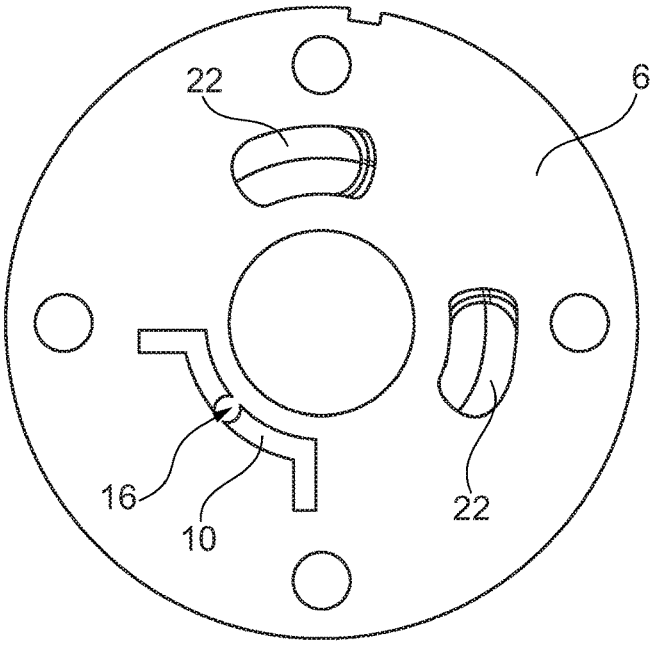
FIG. 4 shows a side view of the locking cover installed in FIG. 1, which is illustrated from an inside, i.e. a side facing the rotor in the operating state, and, in particular, the course of the first channel section as well as the arrangement thereof with respect to the locking gates, are readily apparent.

The course of first channel section 10 is also clearly apparent in FIG. 4, which is situated along the circumference, offset with respect to the two slotted gate receptacles 22.

In other words, a hollow pin (blocking pin 14), including diaphragm/flow diaphragm 21, may thus be integrated into a C channel (first channel section 10) of a camshaft adjuster 1, so that it is possible to cover diaphragm opening (through-hole 15) with the aid of a slotted gate (first channel section 10, including projection area 16) in the locking position/blocking position. Hollow pin 14 seals C channel 10 against the tank/recovery tank in the operating state. Upon dropping below a minimum pressure, hollow pin 14 moves in the direction of the tank as a result of the spring force of the spring element and thus opens C channel 10. Diaphragm opening 15 is covered when starting from the locking position/blocking position. This achieves the fact that the pressure buildup in C channel 10 upon engine startup is able to take place without the oil/hydraulic medium flowing out directly through diaphragm 21, which may cause problems with the starting functionality, in particular in the case of low viscosity oil. Due to the partial coverage of the contact surface (end face 17) of pin/hollow pin 14 in this position, a higher pressure is needed to set pin 14 in motion. Due to the subsequent release of a larger active surface (circular ring surface of the entire pin head immediately upon insertion of the pin), the action of force upon pin 14 is further increased by the oil pressure. A fast and secure closing of the C-T port thus occurs during startup, even at very low viscosities. The coordination of the starting and closing dynamic of pin 14 takes place via the configuration of spring force and the negotiation of covered pin surface/end face 17 with the released surface.

The hollow pin preferably has an axial passage (through-hole 15, preferably designed as a bore). This passage 15 may be provided with a diaphragm 21. The position of diaphragm 21 is axially freely selectable as needed. The axial width of diaphragm 21 is preferably smaller than the pin length/length of pin 14. The surface area of diaphragm (diameter) 21 is smaller than the surface area/diameter of through-hole 15. The material of the pin may be plastic or another material, depending on the application. The slotted gate (first channel section 10) and projection area 16 are introduced into cover/locking cover 6 in such a way that a connection between pin 14 and C channel 10 exists even in the locking position/blocking position and only a covering of diaphragm bore 15/21 of pin 14 is achieved. Pin 14 preferably has a smooth head, i.e., a smooth/even end face 17, preferably without indentations, to prevent a transverse inflow into diaphragm bore 15. This requires a special indentation/a special projection area 16 in C channel 10 for flowing out into diaphragm opening 15 in the case of a shutdown outside the locking position.

LIST OF REFERENCE NUMERALS

1 camshaft adjuster
2 stator
3 rotor
4 first locking element
5 second locking element
6 locking cover
7 vane
8 working chamber
9 hydraulic channel
10 first channel section
11 second channel section
12 inlet opening
13 outlet opening
14 blocking pin
15 through-hole
16 projection area
17 first end face
18 first portion
19 second portion
20 third portion
21 flow diaphragm
22 slotted gate receptacle

The invention claimed is:

1. A camshaft adjuster for an internal combustion engine, the camshaft adjuster comprising:

a stator;

a rotor rotatably supported in an interior of the stator;

a locking cover connected to the stator;

a hydraulically actuatable locking element being accommodated in the rotor, the locking element engaging with the locking cover in at least one blocking position and blocking a rotation of the rotor relative to the stator and being situated in at least one unblocking position in such a way that the rotor is rotatable relative to the stator;

a blocking pin acting in at least one hydraulic channel hydraulically connected to the locking element, in such a way that the at least one hydraulic channel is connected to a recovery tank or is disconnected from the recovery tank depending on a position of the blocking pin, the at least one hydraulic channel including a first channel section introduced into the locking cover configured for fluid to flow through and into the recovery tank in the at least one unblocking position, the first channel section and the blocking pin being designed and situated relative to each other in such a way that a first end face of the blocking pin axially abuts the locking cover at the first channel section to seal the at least one hydraulic channel from the recovery tank in at least one first end position, within a pressure range prevailing in the at least one hydraulic channel by way of contact with the locking cover, the blocking pin being arranged with respect to the first channel section such that the first end face of the blocking pin directly axially seals at least one portion of the first channel section in the at least one first end position.

2. The camshaft adjuster as recited in claim 1 wherein to switch from the at least one blocking position into the at least one unblocking position, the blocking pin is displaceable in an axial direction within the rotor between the at least one first end position, in which the blocking pin is situated up to a predetermined first hydraulic pressure value, and a second end position, in which the blocking pin is situated upon reaching a second hydraulic pressure value.

3. The camshaft adjuster as recited in claim 1 wherein the blocking pin has a second end face facing away from the locking cover, the second end face abutting the at least one hydraulic channel in a second end position on a rotor side to seal the recovery tank.

4. The camshaft adjuster as recited in claim 1 wherein the first end face has an annular design and a hydraulic pressure set in the at least one hydraulic channel is applied to the first end face in the at least one first end position.

5. The camshaft adjuster as recited in claim 1 wherein the blocking pin is hollow and includes a continuous through-hole in an axial direction.

6. The camshaft adjuster as recited in claim 5 wherein the blocking pin includes a flow diaphragm reducing a cross section of the through-hole.

7. The camshaft adjuster as recited in claim 5 wherein the through-hole is situated in such a way that a flow of hydraulic medium is prevented in the at least one first end position of the block pin.

8. The camshaft adjuster as recited in claim 1 wherein the first channel section is hydraulically connected to a second channel section of the at least one hydraulic channel introduced into the rotor.

9. The camshaft adjuster as recited in claim 1 wherein the blocking pin is spring-pretensioned to abut the locking cover and seal the at least one hydraulic channel from the recovery tank in the at least one blocking position.

10. The camshaft adjuster as recited in claim 1 wherein the blocking pin seals the first channel section from the recovery tank in the at least one first end position by the first end face of the blocking pin axially contacting the locking cover.

11. The camshaft adjuster as recited in claim 1 wherein the first end face of the blocking pin axially contacts a projection area of the locking cover, the first channel section being recessed away from the projection area.

12. The camshaft adjuster as recited in claim 1 wherein the first channel section is configured to direct fluid into the recovery tank in the at least one unblocking position.

13. The camshaft adjuster as recited in claim 1 wherein the at least one hydraulic channel includes a second channel section formed in the rotor, the first channel section configured for providing fluid from the second channel section to the blocking pin in the at least one unblocking position.

* * * * *